United States Patent [19]

Kahl

[11] 4,294,591

[45] Oct. 13, 1981

[54] MOUNTING FOR HIGH-VOLTAGE ELECTRODE SUPPORT FRAME IN AN ELECTROSTATIC PRECIPITATOR

[75] Inventor: Melvin R. Kahl, Richland, Pa.

[73] Assignee: Envirotech Corporation, Menlo Park, Calif.

[21] Appl. No.: 148,845

[22] Filed: May 12, 1980

[51] Int. Cl.[3] ..... B03C 3/70; B03C 3/41; H01B 17/54; H01B 17/52

[52] U.S. Cl. ..... 55/120; 55/146; 55/148; 174/211

[58] Field of Search ..... 55/108, 117, 120, 139, 55/146, 148; 174/15 BH, 139, 211; 361/235

[56] References Cited

U.S. PATENT DOCUMENTS

| | | | |
|---|---|---|---|
| 1,391,436 | 9/1921 | Welch | 55/146 |
| 2,510,686 | 6/1950 | Delange | 55/146 |
| 3,033,918 | 5/1962 | Wiemer | 55/120 |
| 3,714,762 | 2/1973 | Fillies et al. | 55/120 |
| 3,755,611 | 8/1973 | Queck et al. | 55/146 |

FOREIGN PATENT DOCUMENTS

| | | | |
|---|---|---|---|
| 1114785 | 10/1961 | Fed. Rep. of Germany | 55/139 |
| 63946 | 8/1949 | Netherlands | 55/146 |

*Primary Examiner*—David L. Lacey
*Attorney, Agent, or Firm*—Robert E. Krebs; Thomas J. McNaughton

[57] ABSTRACT

A mounting assembly (12) for suspending an electrically conductive support frame for high-voltage electrodes (10) in an electrostatic precipitator comprises an electrical insulator (20) secured to a roof portion (13) of the precipitator and a fastening means for securing the support frame to the insulator (20). The insulator (20) has a bore therethrough, and is positioned circumjacent an aperture in the roof portion (13). The fastening means includes a rod (23), the lower end of which is attached to a horizontal member (11) of the support frame and the upper end of which extends through the bore of the insulator (20). The upper end of the rod (23) is secured to an annular member (25), which bears against a top portion of the insulator (20) to support the weight of the support frame and of the high-voltage electrodes (10) attached thereto. A high-temperature heat resistant porous fabric skirt (30) is provided within the bore of the insulator (20) to retain a quantity of heated air in a region adjacent the interior wall of the insulator (20), thereby enabling the insulator (20) to be uniformly heated.

9 Claims, 2 Drawing Figures

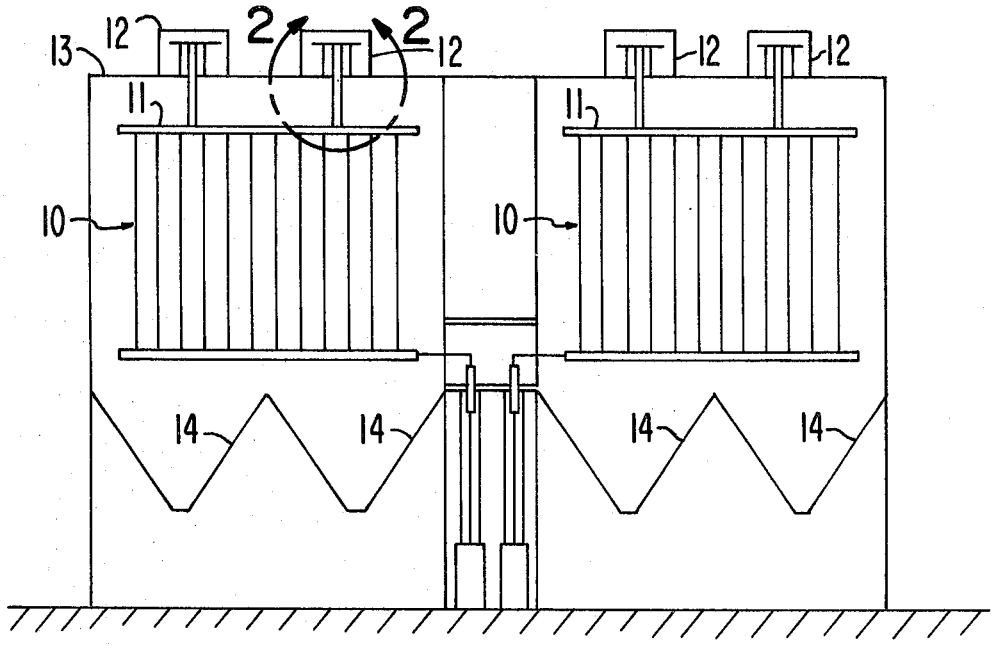
FIG. 1
FIG. 2
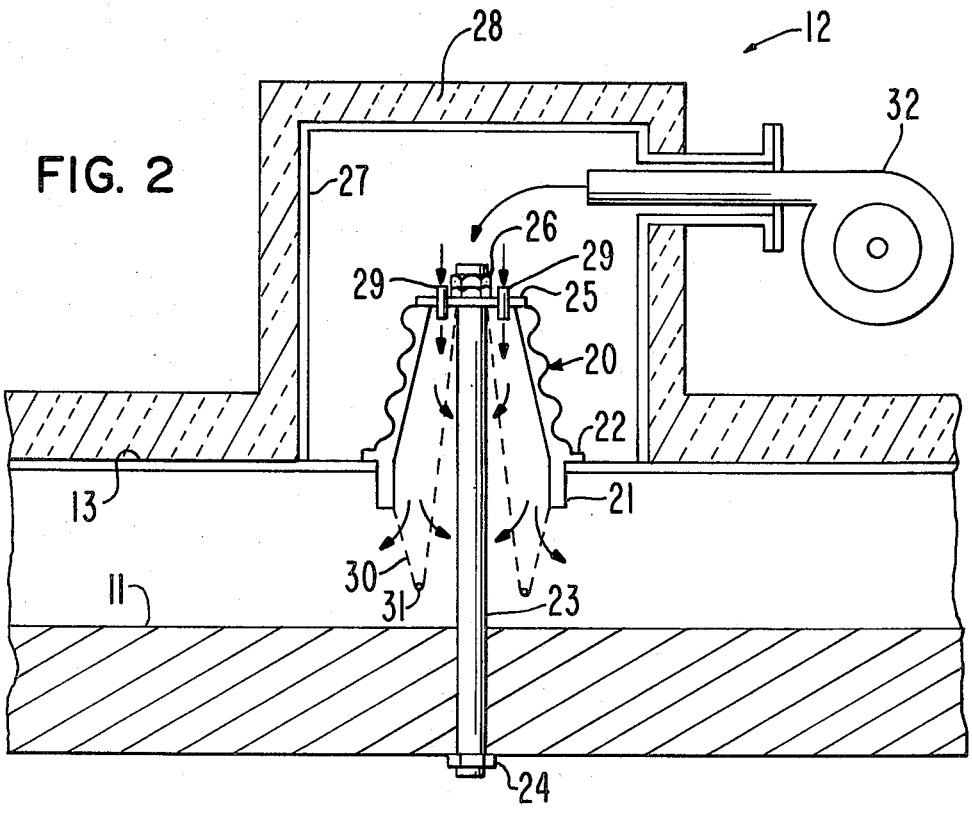

MOUNTING FOR HIGH-VOLTAGE ELECTRODE SUPPORT FRAME IN AN ELECTROSTATIC PRECIPITATOR

BACKGROUND OF THE INVENTION

1. Field of the Invention

This invention pertains to the mounting of a support frame for high-voltage electrodes in an electrostatic precipitator.

2. State of the Prior Art

In an electrostatic precipitator, an electrically conductive support frame for high-voltage electrodes is suspended from the roof of the precipitator by a number of mounting assemblies that carry the weight of the support frame and of the electrodes attached thereto. Each mounting assembly includes an electrical insulator to isolate the high-voltage support frame and electrodes from electrically grounded components of the precipitator.

In the prior art, each insulator for isolating the high-voltage support frame in an electrostatic precipitator from the roof of the precipitator had a surface directly exposed to a particulate-laden gas in the interior of the precipitator. Consequently, a layer of particulates (e.g., fly ash from a coal-fired burner), or a coating comprising a mixture of moisture and such particulates, tended to form on the surfaces of the high-voltage insulators. When such a coating developed to the point where a direct electrical path to ground was established on the surface of an insulator, the high-voltage electrodes would be electrically shorted. Failure of a few high-voltage insulators, or even one such insulator, in an electrostatic precipitator could cause serious reduction in particulate collection efficiency.

In the prior art, it was customary to supply heated air to the vicinity of each high-voltage insulator in an electrostatic precipitator in order to prevent the air adjacent the insulator from passing through a dew point, particularly during precipitator startup. In this way, the formation of moisture droplets in the vicinity of each insulator was inhibited. Typically, a single large blower would be used to move heated air through a network of thermally insulated piping to the vicinity of each of the insulators. Because of the long runs of piping required for the heated air to reach many of the high-voltage insulators, auxiliary heaters were often provided adjacent some or all of the insulators to prevent the heated air from being cooled to the dew point by winter weather conditions.

Prior art systems for delivering heated air to the individual high-voltage insulators in electrostatic precipitators were expensive because of the long runs of piping required. Furthermore, prior art systems for delivering heated air were generally unable to maintain a uniform distribution of heated air over the entire surface of each insulator. Thus, cool spots on which condensation could occur tended to develop on the high-voltage insulators in the prior art.

OBJECTS OF THE INVENTION

It is an object of the present invention to provide a mounting assembly including a high-voltage insulator for suspending an electrically conductive support frame for high-voltage electrodes in an electrostatic precipitator, wherein a self-contained source of heated air is provided for the high-voltage insulator.

It is a further object of the present invention to provide a mounting assembly including a high-voltage insulator for suspending an electrically conductive support frame for high-voltage electrodes in an electrostatic precipitator, wherein the bores of the insulators are protected from direct exposure to particulate-laden gas passing through the precipitator.

DESCRIPTION OF THE DRAWING

FIG. 1 is a schematic cross-sectional representation of an electrostatic precipitator embodying a mounting assembly according to the present invention.

FIG. 2 is enlarged fragmentary cross-sectional view of that portion of FIG. 1 included within line 2—2.

DESCRIPTION OF PREFERRED EMBODIMENT

In an electrostatic precipitator, high-voltage corona-generating electrodes are typically attached to a support frame suspended from the roof of the precipitator. A number of mounting assemblies are ordinarily provided to secure the support frame to the precipitator roof. In FIG. 1, a bank of bottom-powered electrostatic precipitator modules of the kind described in copending patent application Ser. No. 148,846, filed May 12, 1980 is shown. This copending application is owned by the assignee of the present application. A mounting assembly according to the present invention could, however, generally be used to secure a high-voltage electrode support frame to the roof of any type of electrostatic precipitator.

As indicated schematically in FIG. 1, a linear array of high-voltage electrodes 10 in each precipitator module is attached by conventional means to a horizontal member 11 of an electrically conductive support frame, which assumes the electrical potential of the high-voltage electrodes 10. The horizontal member 11 is secured by a plurality of mounting assemblies 12 to an electrically grounded roof portion 13 of the precipitator module.

Each linear array of high-voltage electrodes 10 is typically positioned between a pair of parallel collector plate electrodes (not shown) that are maintained at ground potential. As a particulate-laden gas stream (e.g., flue gas from a coal-fired burner) passes between adjacent collector plates in the precipitator, the strong electric field near each of the high-voltage electrodes 10 causes ionization of the gas. This ionization process causes electric charge to be imparted to the particulates in the gas stream. The electric field established between the high-voltage electrodes 10 and the grounded collector plates drives the charged particulates, according to the sign of their charge, toward either the high-voltage electrodes 10 or the grounded collector plates. With a negative voltage applied to the high-voltage electrodes 10, as is the usual arrangement in an industrial electrostatic precipitator, negatively charged particulates are drawn to the collector plates for deposition thereon, and any positively charged particulates present are attracted to the high-voltage electrodes 10. Electrophoretic forces due to non-uniformities in the electric field also act on the particulates, regardless of whether the particulates are charged or neutral, and are also responsible for deposition of particulates on the high-voltage electrodes. Periodically, the high-voltage electrodes 10 and the collector plates are mechanically rapped to dislodge accumulated particulates therefrom. The particulates rapped from the electrodes fall by gravity to hoppers 14 located at the bottom of the precipitator, where the particulates are collected for eventual removal.

Each mounting assembly 12 comprises a plurality of high-voltage insulators 20 for electrically isolating the support frame and the attached high-voltage electrodes 10 from the electrically grounded roof portion 13 of the precipitator. Each mounting assembly 12 also comprises corresponding fastening means for securing the support frame to the insulators 20.

Each high-voltage insulator 20, as shown in FIG. 2, is preferably made of a ceramic material such as alumina, and is generally of cylindrical or truncated conical configuration with a central bore therethrough. The particular configuration of the insulator 20, and of the bore therethrough, are not critical to the present invention.

The insulator 20 is positioned circumjacent an aperture in the roof portion 13 of the precipitator module, so that the bore of the insulator 20 is aligned with the aperture in the roof portion 13. As shown in FIG. 2, the insulator 20 may be configured to have a cylindrical lower end portion 21 that can be inserted downward through the aperture in the roof portion 13, and a flanged portion 22 that overlaps the edge of the roof portion 13 circumjacent the aperture so as to limit further downward insertion of the insulator 20 through the aperture.

The fastening means for securing the support frame to the insulator 20 comprises a rod 23, which passes vertically through a tight-fitting hole in the horizontal member 11 of the support frame and extends upward through the bore of the insulator 20. A lower end of the rod 23 is attached (as by welding) to a plate 24, which is secured (as by welding) to the bottom surface of the horizontal member 11. An upper end of the rod 23 extends through the bore of the insulator 20; and an annular member 25 is fitted over the upper end of the rod 23 to cover the bore of the insulator 20. A peripheral portion of the annular member 25 bears downward against a top surface portion of the insulator 20; and a nut, or preferably a pair of nuts, 26 is threaded tightly over the upper end of the rod 23 to secure the annular member 25 tightly against the insulator 20. The insulator 20 is under compression due to the downward force exerted by the annular member 25 thereon because of the weight of the support frame.

A housing structure 27 is secured by conventional means (e.g., welding) on the roof portion 13 of the precipitator module to enclose the insulator 20 and the upper end of the rod 23. The housing structure 27 is covered by a layer of thermal insulation 28. Inlet ports 29, preferably of tubular configuration, are provided through the annular member 25 to permit hot clean air to flow from the interior of the housing structure 27 into the bore of the insulator 20.

A high-temperature heat resistant fabric skirt 30 of electrically non-conductive material is mechanically fastened, as shown in FIG. 2, to a lower portion of the insulator 20 extending into the interior of the precipitator module and to the underside of the annular member 25. In that way, gas passing through the inlet ports 29 from the interior of the housing structure 27 into the bore of the insulator 20 can enter the precipitator module only by passing through the pores in the skirt fabric. A hoop ring 31 is positioned around the rod 23, and is attached to the skirt 30 to prevent the skirt 30 from collapsing.

A conventional heat gun 32 is provided for introducing heated air into the interior of the housing structure 27. The heat gun 32 takes ambient air from the atmosphere, which is typically at a temperature in the range from −10° F. to 90° F., and heats the air to approximately 300° F. A negative pressure (typically from 8 to 10 inches w.g.) is usually maintained in an electrostatic precipitator during operation, which causes the heated air from the heat gun 32 to be drawn through the inlet ports 29 into the region within the bore of the insulator 20 that is enclosed by the interior wall of the insulator 20 and the fabric skirt 30. The thermal insulation 28 serves to minimize thermal losses from the housing structure 27 due to cold weather conditions that might occur in the environment of the precipitator.

Air flow impedance through the pores of the fabric skirt 30 is sufficient for the skirt 30 to retain a quantity of the incoming heated air in the region between the interior wall of the insulator 20 and the skirt 30. In this way, the interior wall of the insulator 20 is uniformly heated during precipitator startup, thereby preventing condensation from forming on the insulator 20. Also, the fabric skirt 30 and the quantity of heated air retained between the skirt 30 and the interior wall of the insulator 20 prevent direct exposure of the insulator 20 to the particulate-laden flue gas passing through the precipitator module.

By providing a separate heat gun 32 for each mounting assembly 12, the long runs of thermally insulated piping that were necessary in the prior art for supplying heated air from a single source to the various high-voltage insulators can be eliminated, thereby providing a significant cost saving. Furthermore, since each heat gun 32 provides only the relatively small quantity of heated air needed for a single insulator 20, the present invention is more economical than prior art heating techniques that required a large blower to pressurize and distribute heated air throughout a network of thermally-insulated piping.

According to the present invention, if the heat gun 32 of one mounting assembly 12 were to malfunction, the precipitator could be maintained in operation while the malfunctioning heat gun is being replaced. Thus, malfunctioning of a single heat gun 32 would not require precipitator shut-down and on-site maintenance and repair. In many cases, it would be more economical simply to discard a malfunctioning heat gun 32 than to repair it. Several thermostatically interconnected heat guns 32 could be provided for each housing structure 27 so that, if one heat gun 32 were to fail, the other heat guns could be programmed to supply hotter air to compensate for the malfunctioning heat gun.

The present invention has been described above in terms of a particular embodiment, which is not to be construed in limitation of the invention, but rather as a disclosure of the best mode presently contemplated by the inventor for carrying out his invention. The scope of the invention is defined by the following claims and their equivalents.

What is claimed is:

1. In an electrostatic precipitator having a housing with an opening formed therein and a mounting assembly suspending an electrically conductive support frame for a high-voltage electrode in the electrostatic precipitator, said mounting assembly comprising:

(a) an electrical insulator having a bore therethrough, said insulator being secured to said housing of the precipitator circumjacent the opening therein;

(b) a substantially gas-tight housing portion, stationed on said housing over said opening, said housing portion enclosing said insulator;

(c) fastening means for securing said support frame to said insulator, said fastening means including:

(i) an elongate portion affixed to said support frame and extending upward through said opening and through said insulator bore, and (ii) a connecting portion extending outward from said elongate portion and bearing against said insulator, said connecting portion having inlet ports for permitting gas flow from said housing portion into said bore;

(d) means for introducing heated gas into said housing portion; and (e) a porous fabric skirt positioned in said insulator bore so that heated gas flowing from said housing portion into said insulator bore passes through said porous fabric skirt as it enters into said precipitator, said skirt being mechanically fastened to said connecting portion and to a bottom portion of said insulator to prevent direct exposure of the bore of the insulator to particulate-laden gas within the precipitator housing.

2. The precipitator of claim 1 wherein said electrical insulator is elongate along a vertical axis with said bore extending along said axis, and wherein said connecting portion of said fastening means bears against a top surface of said insulator.

3. The precipitator of claim 2 wherein said electrical insulator has a generally truncated conical configuration.

4. The precipitator of claim 1 wherein said elongate portion of said fastening means comprises a rod, and wherein said connecting portion of said fastening means comprises a generally annular member attached to said rod.

5. The precipitator of claim 4 wherein said rod is positioned generally coaxially with respect to said bore, and wherein said annular member is fitted over and attached to said rod, a peripheral portion of said annular member overlapping and bearing against a top surface of said insulator.

6. The precipitator of claim 5 wherein said annular member is attached to said rod by a screw-thread connection.

7. The precipitator of claim 5 wherein said inlet ports for permitting gas flow from said housing portion into said insulator bore are of tubular construction.

8. The precipitator of claim 1 wherein said means for introducing heated gas into said housing portion comprises a heat gun directly and removably attached to the housing portion.

9. The precipitator of claim 1 wherein a hoop ring is positioned around said elongate portion of said fastening means and is attached to said skirt in order to prevent said skirt from collapsing.

* * * * *